US011264191B2

(12) United States Patent
Tanigaki et al.

(10) Patent No.: US 11,264,191 B2
(45) Date of Patent: Mar. 1, 2022

(54) BREAKER

(71) Applicant: Mitsubishi Electric Corporation, Tokyo (JP)

(72) Inventors: Shuichi Tanigaki, Tokyo (JP); Satoru Maeno, Tokyo (JP); Daisuke Fujita, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 17/052,604

(22) PCT Filed: Jun. 15, 2018

(86) PCT No.: PCT/JP2018/022971

§ 371 (c)(1),
(2) Date: Nov. 3, 2020

(87) PCT Pub. No.: WO2019/239590

PCT Pub. Date: Dec. 19, 2019

(65) Prior Publication Data

US 2021/0366674 A1 Nov. 25, 2021

(51) Int. Cl.
*H01H 3/30* (2006.01)
*H01H 33/12* (2006.01)
(Continued)

(52) U.S. Cl.
CPC ..... *H01H 33/42* (2013.01); *H01H 3/3042* (2013.01); *H01H 33/12* (2013.01); *H01H 71/04* (2013.01)

(58) Field of Classification Search
CPC ..... H01H 33/42; H01H 33/12; H01H 33/666; H01H 33/6662; H01H 2033/6667; H01H 3/3042; H01H 3/28; H01H 71/04
(Continued)

(56) References Cited

U.S. PATENT DOCUMENTS 4,839,476 A 6/1989 Okuno
5,901,838 A * 5/1999 Nakatani ..... H01H 3/30 200/400
(Continued)

FOREIGN PATENT DOCUMENTS

JP S63304542 A 12/1988
JP H0629868 Y2 8/1994
(Continued)

OTHER PUBLICATIONS

International Search Report (PCT/ISA/210) dated Aug. 28, 2018, by the Japan Patent Office as the International Searching Authority for International Application No. PCT/JP2018/022971.
(Continued)

*Primary Examiner* — William A Bolton
(74) *Attorney, Agent, or Firm* — Buchanan Ingersoll & Rooney PC

(57) ABSTRACT

A breaker includes a stationary contact, a movable contact, an operation device including a link portion liked to the movable contact and including an output lever rotatably supported, the operation device operating rotation of the output lever in accordance with a first control signal for a command for pulling out the movable contact and a second control signal for a command for inserting the movable contact, and an auxiliary contact to switch between turn-on and turn-off of an input of the first control signal and the second control signal to the operation device in conjunction with operation of the output lever, the auxiliary contact being able to be used in a circuit configuration to monitor a state of the operation device. The output lever rotates so as to operate a first link portion on a side toward a first direction with respect to a rotational center of the output lever.

4 Claims, 4 Drawing Sheets

(51) Int. Cl.
*H01H 33/42* (2006.01)
*H01H 71/04* (2006.01)

(58) Field of Classification Search
USPC ..... 218/154, 153, 140, 14, 78, 84, 92
See application file for complete search history.

(56) References Cited

U.S. PATENT DOCUMENTS 6,232,569 B1 * 5/2001 Nakajima ..... H01H 3/3042 200/17 R
6,610,949 B2 * 8/2003 Mori ..... H01H 3/3015 200/400
7,528,336 B2 * 5/2009 Hashimoto ..... H01H 33/40 200/400
8,207,804 B2 * 6/2012 Ohtsuka ..... H01H 3/30 335/174
8,330,065 B2 * 12/2012 Ohda ..... H01H 3/3031 200/400
9,431,185 B2 * 8/2016 Tanigaki ..... H01H 3/3031
2014/0076854 A1 * 3/2014 Okubo ..... H01H 33/42 218/154

FOREIGN PATENT DOCUMENTS

JP H0817301 A 1/1996
JP 2007294363 A 11/2007

OTHER PUBLICATIONS

Written Opinion (PCT/ISA/237) dated Aug. 28, 2018, by the Japan Patent Office as the International Searching Authority for International Application No. PCT/JP2018/022971.

* cited by examiner

BREAKER

FIELD

The present invention relates to a breaker including an operation device that opens/closes a circuit contact.

BACKGROUND

There are breakers installed in facilities such as a substation or a switching station. Some of the breakers include an operation device that opens/closes a circuit contact by utilizing a spring force of a torsion bar. The circuit contact includes a stationary contact and a movable contact capable of being inserted into the stationary contact and being pulled out from the stationary contact. The operation device includes an output lever linked to the movable contact. The output lever is rotatably supported. The torsion bar is held in a twisted state, and consequently elastic energy is stored in the torsion bar. When the torsion bar is released from the twisted state, the torsion bar releases the elastic energy, thereby generating a spring force. The operation device utilizes the spring force of the torsion bar to rotate the output lever so as to pull out the movable contact from, and insert the movable contact into, the stationary contact. Patent Literature 1 discloses an operation device that performs opening/closing operation by utilizing a spring force of a torsion bar.

CITATION LIST

Patent Literature

Patent Literature 1: Japanese Patent Application Laid-open No. S63-304542

SUMMARY

Technical Problem

A breaker is provided with an auxiliary contact connected to a control panel that controls the breaker. The auxiliary contact includes a plurality of contacts. Each of the contacts is linked to the output lever through a link mechanism. In accordance with operation of the output lever, the auxiliary contact is switched between: a state in which one of the contacts is turned on, while the other one is turned off; and a state in which one of the contacts is turned off, while the other one is turned on. The opening/closing operation by the operation device is controlled in accordance with a control signal input from the control panel through the contact being turned on. Each of the contacts is switched between on and off in conjunction with the opening/closing operation by the operation device. Accordingly, through which of the contacts a control signal is input to the operation device is changed in accordance with the opening/closing operation by the operation device. The auxiliary contact may be included in a circuit configuration of the control panel to monitor the state of the operation device.

In conventional breakers, the auxiliary contact is located at a position which may vary depending on the design of the breaker. Accordingly, the auxiliary contact may be located away from the operation device. As the auxiliary contact is located further away from the operation device, the size of the components constituting the link mechanism is increased, or the number of components is increased. This makes the configuration of the link mechanism more complicated. For this reason, the conventional breakers have a problem that the link mechanism that links the auxiliary contact and the operation device to each other may have a complicated configuration.

The present invention has been achieved to solve the above problems, and an object of the present invention is to provide a breaker capable of linking an auxiliary contact and an operation device to each other by a link mechanism with a simple configuration.

Solution to Problem

In order to solve the above problems and achieve the object, a breaker according to the present invention includes: a stationary contact; a movable contact capable of being pulled out from the stationary contact and being inserted into the stationary contact; an operation device including a link portion liked to the movable contact and including an output lever rotatably supported, the operation device operating rotation of the output lever in accordance with a first control signal for a command for the pull-out and a second control signal for a command for the insertion; and an auxiliary contact to switch between turn-on and turn-off of an input of the first control signal and the second control signal to the operation device in conjunction with operation of the output lever, the auxiliary contact being able to be used in a circuit configuration to monitor a state of the operation device. The output lever rotates so as to operate the link portion on a side toward a first direction with respect to a rotational center of the output lever. The auxiliary contact is provided on the operation device at a position on a side toward a second direction with respect to the rotational center, the second direction being opposite to the first direction.

Advantageous Effects of Invention

According to the present invention, there is an effect where it is possible to link an auxiliary contact and an operation device to each other by a link mechanism with a simple configuration.

DESCRIPTION OF EMBODIMENTS

A breaker according to embodiments of the present invention will be described in detail below with reference to the accompanying drawings. The present invention is not limited to the embodiments.

First Embodiment

Figure 1:
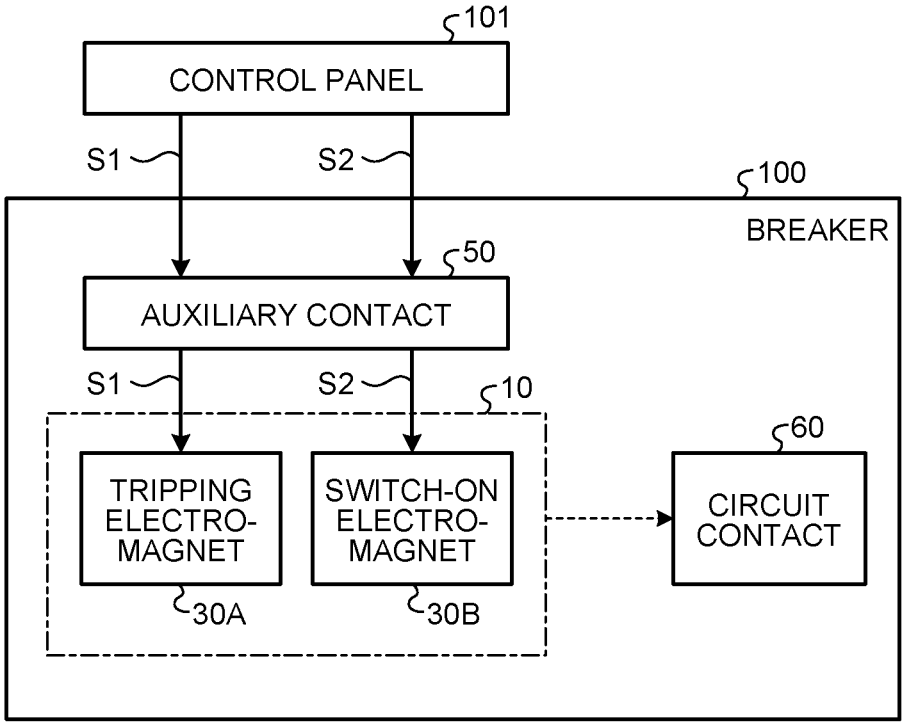
FIG. 1 is a conceptual diagram of a system that causes a breaker to operate according to a first embodiment of the present invention.

FIG. 1 is a conceptual diagram of a system that causes a breaker 100 to operate according to a first embodiment of the present invention. The breaker 100 opens/closes a power path in facilities such as a substation or a switching station. A control panel 101 is installed in a control room to control operation of the facilities. The control panel 101 controls the breaker 100 by causing an operation device 10 to perform the power path opening/closing operation. The breaker 100 includes: the operation device 10; and a circuit contact 60 whose opening/closing operation is controlled by the operation device 10. In the breaker 100, a single operation device 10 operates a circuit contact 60 for one phase. In the breaker 100, it is allowable that a single operation device 10 operates circuit contacts 60 for three phases.

The breaker 100 includes an auxiliary contact 50 connected to the control panel 101 and to the operation device 10. Opening/closing operation of the operation device 10 is controlled in accordance with an opening control signal S1 and a closing control signal S2. The opening control signal S1 and the closing control signal S2 are control signals to be input from the control panel 101 through the auxiliary contact 50. The operation device 10 is provided with a tripping electromagnet 30A and a switch-on electromagnet 30B. The tripping electromagnet 30A is excited in accordance with the opening control signal S1 as a first control signal. The switch-on electromagnet 30B is excited in accordance with the closing control signal S2 as a second control signal. Operation of the operation device 10 by the function of the tripping electromagnet 30A and the function of the switch-on electromagnet 30B will be described later. It is allowable that the auxiliary contact 50 is included in a circuit configuration of the control panel 101 to monitor the state of the operation device 10.

Figure 2:
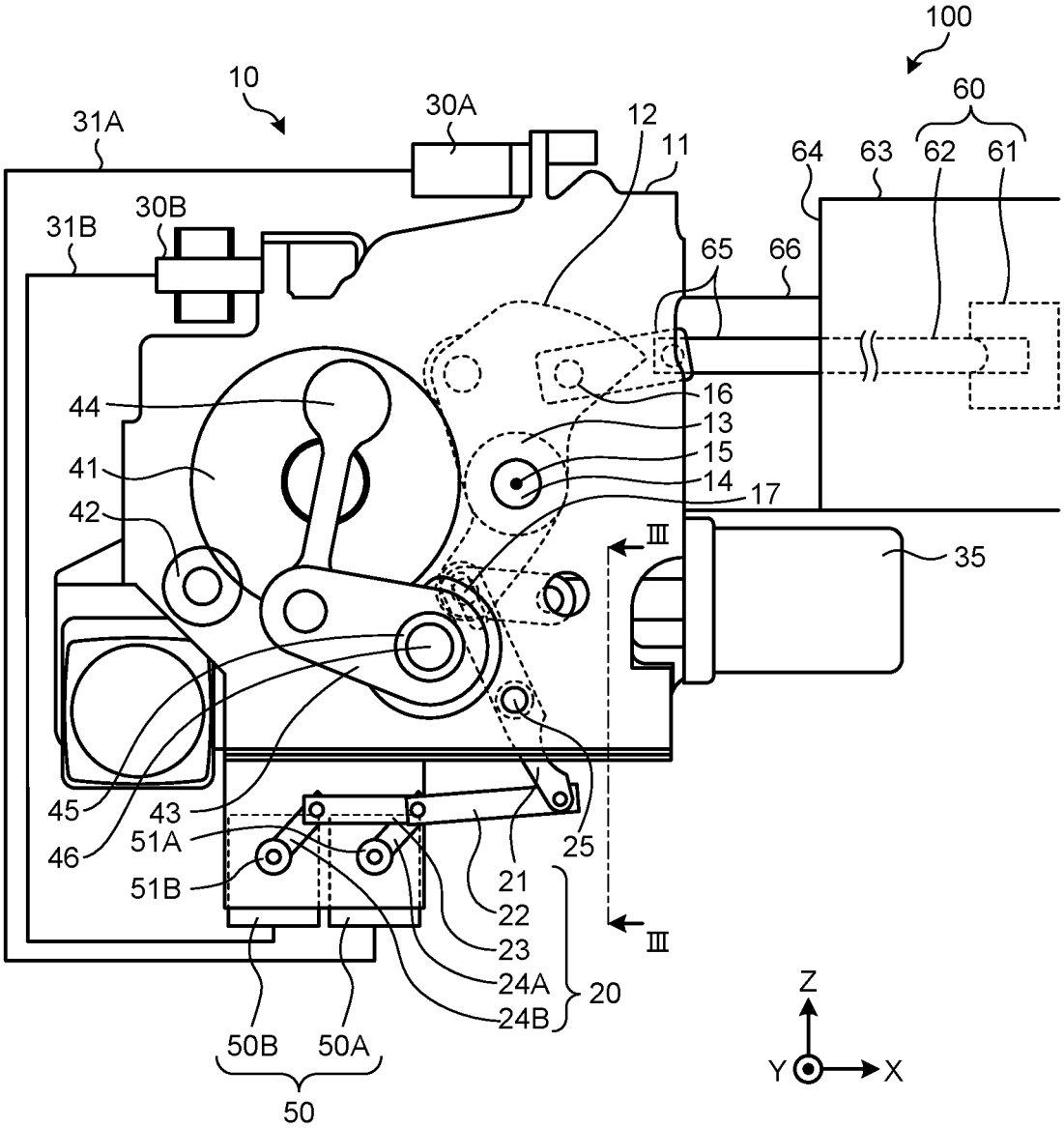
FIG. 2 is a front view of the breaker according to the first embodiment of the present invention.
Figure 3:
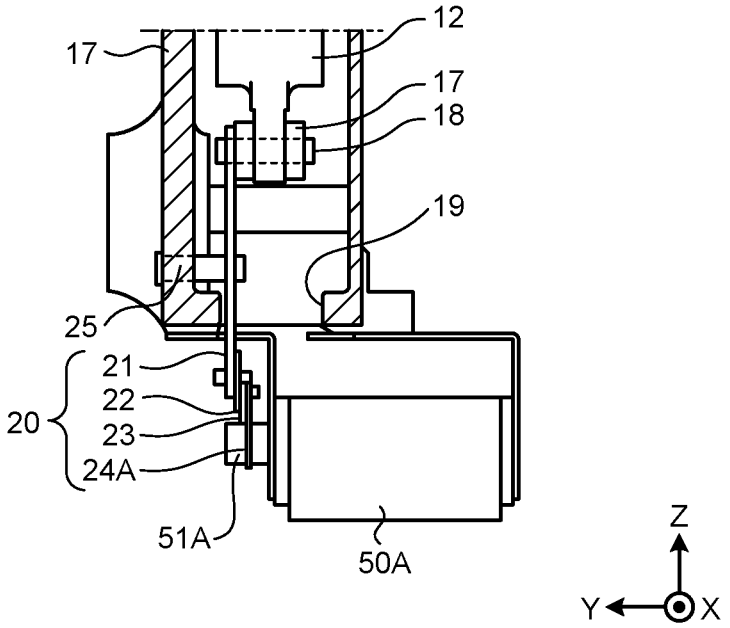
FIG. 3 is a cross-sectional view of the breaker taken along the line III-III illustrated in FIG. 2.
Figure 4:
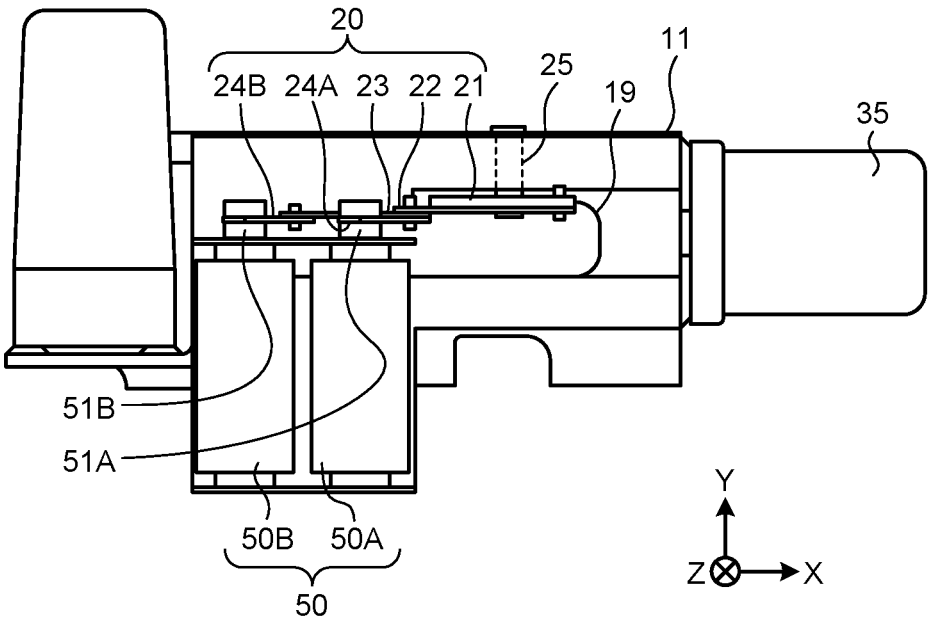
FIG. 4 is a bottom view illustrating an operation device and an auxiliary contact that are included in the breaker illustrated in FIG. 2.

FIG. 2 is a front view of the breaker 100 according to the first embodiment of the present invention. FIG. 3 is a cross-sectional view of the breaker 100 taken along the line III-III illustrated in FIG. 2. FIG. 4 is a bottom view illustrating the operation device 10 and the auxiliary contact 50 that are included in the breaker 100 illustrated in FIG. 2. In FIGS. 2 to 4, it is assumed that three axes, that is, the X-axis, the Y-axis, and the Z-axis, are perpendicular to each other. A direction parallel to the X-axis is referred to as "X-axis direction". A direction parallel to the Y-axis is referred to as "Y-axis direction". A direction parallel to the Z-axis is referred to as "Z-axis direction". In the first embodiment, the Z-axis direction is defined as the vertical direction. The Z-axis direction illustrated by the arrow direction is defined as a positive Z direction that is a first direction, while the direction opposite to the arrow direction is defined as a negative Z direction that is a second direction. The X-axis direction illustrated by the arrow direction is defined as a positive X direction, while the direction opposite to the arrow direction is defined as a negative X direction. The Y-axis direction illustrated by the arrow direction is defined as a positive Y direction, while the direction opposite to the arrow direction is defined as a negative Y direction.

The breaker 100 includes a tank 63 filled with insulating gas. The operation device 10 is attached to an end face 64 of the tank 63. The circuit contact 60 is accommodated in the tank 63. The circuit contact 60 includes a stationary contact 61 and a movable contact 62. The circuit contact 60 opens the power path by pulling out the movable contact 62 from the stationary contact 61. The circuit contact 60 closes the power path by inserting the movable contact 62 into the stationary contact 61.

A housing 11 of the operation device 10 is fixed to the end face 64 through a mounting seat 66. The operation device 10 includes an output lever 12 that is rotatable about a rotational shaft 13. The rotational shaft 13 is located parallel to the Y-axis. The rotational shaft 13 is rotatably supported by the housing 11 through a bearing. FIGS. 2 to 4 omit illustrations of the bearing.

The rotational shaft 13 is rotatably attached to the housing 11 so that the output lever 12 is rotatably supported in the housing 11. An end portion of a torsion bar 14 that is a shut-off spring is fixed to the rotational shaft 13. The torsion bar 14 is a bar-shaped elastic member. The torsion bar 14 applies a rotational force to the output lever 12. In FIG. 2, the torsion bar 14 is inserted through the rotational shaft 13 and is provided to extend in the negative Y direction. The end portion of the torsion bar 14 is inserted into the rotational center 15 of the output lever 12. FIG. 4 omits illustrations of the torsion bar 14.

A link mechanism 65 is linked between the output lever 12 and the movable contact 62, and causes the movable contact 62 to operate in conjunction with rotation of the output lever 12. One end portion of the link mechanism 65 is connected to a first link portion 16 of the output lever 12. The other end portion of the link mechanism 65 is connected to the movable contact 62. The first link portion 16 is linked to the movable contact 62 through the link mechanism 65. A buffer 35 is connected to a second link portion 17 of the output lever 12. The buffer 35 controls operation of the movable contact 62. The buffer 35 brakes the motion of the movable contact 62 at the end of pulling out the movable contact 62 and at the end of inserting the movable contact 62, so as to soften the mechanical impact received by the movable contact 62.

The auxiliary contact 50 is provided on the bottom plane of the housing 11 and is thus integrated with the operation device 10. The auxiliary contact 50 includes a contact 50A and a contact 50B. The contact 50A and the contact 50B are located next to each other in the X-axis direction. The contact 50A and the tripping electromagnet 30A are connected through a control line 31A. It is thus possible to transmit a signal from the contact 50A to the tripping electromagnet 30A. The contact 50B and the switch-on electromagnet 30B are connected through a control line 31B. It is thus possible to transmit a signal from the contact 50B to the switch-on electromagnet 30B.

The contact 50A includes a rotational mechanism 51A that rotates so as to switch between turn-on and turn-off of the input of the opening control signal S1 to the tripping electromagnet 30A. The opening control signal S1 propagates through the control line 31A and is input to the tripping electromagnet 30A. The contact 50B includes a rotational mechanism 51B that rotates so as to switch between turn-on and turn-off of the input of the closing control signal S2 to the switch-on electromagnet 30B. The closing control signal S2 propagates through the control line 31B and is input to the switch-on electromagnet 30B. Rotational shafts of the rotational mechanisms 51A and 51B are located parallel to the Y-axis. The rotational shafts of the rotational mechanisms 51A and 51B, and the rotational shaft 13 of the output lever 12 are located parallel to each other.

In the following descriptions, a clockwise direction and a counterclockwise direction refer to directions when the operation device 10 is viewed from the front. When the contact 50A receives the opening control signal S1 from the control panel 101 at the time when the rotational mechanism 51A is in a first state illustrated in FIG. 2, the contact 50A inputs the opening control signal S1 to the tripping electromagnet 30A. Thereafter, the rotational mechanism 51A rotates in the counterclockwise direction from the first state, and is thus brought into a second state illustrated in FIG. 5.

The contact 50A then turns off the input of the opening control signal S1 to the tripping electromagnet 30A.

Figure 5:
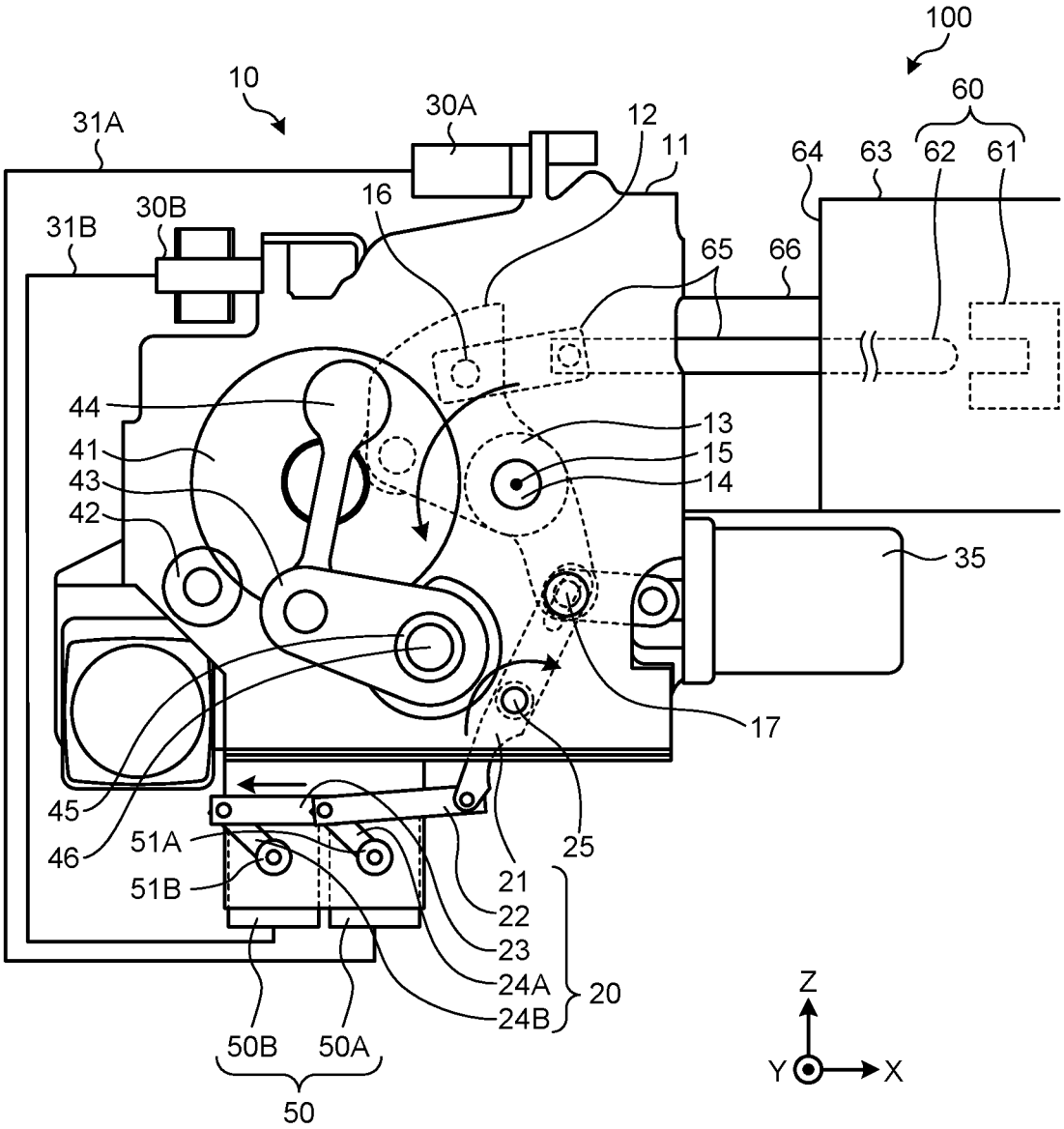
FIG. 5 is a diagram illustrating a state when the breaker illustrated in FIG. 2 opens a power path.

When the contact 50B receives the closing control signal S2 from the control panel 101 at the time when the rotational mechanism 51B is in the second state illustrated in FIG. 5, then the contact 50B inputs the closing control signal S2 to the switch-on electromagnet 30B. Thereafter, the rotational mechanism 51B rotates in the clockwise direction from the second state, and is thus brought into the first state illustrated in FIG. 2. The contact 50B then turns off the input of the closing control signal S2 to the switch-on electromagnet 30B.

A link mechanism 20 links the contact 50A and the contact 50B to the output lever 12 such that the contact 50A and the contact 50B are capable of operating in conjunction with rotation of the output lever 12. As illustrated in FIG. 4, an opening 19 is provided on the bottom plane of the housing 11 through which the link mechanism 20 is inserted. As the opening 19 is provided it is possible to link the output lever 12 inside the housing 11 to the contact 50A and the contact 50B outside the housing 11.

The link mechanism 20 includes: a lever 21 that is rotatable about a rotational shaft 25; and components 22, 23, 24A, and 24B that operate in conjunction with rotation of the lever 21. The rotational shaft 25 is rotatably supported by the housing 11 through a bearing. FIGS. 2 to 4 omit illustrations of the bearing. The rotational shaft 25 is rotatably attached to the housing 11 so that the lever 21 is rotatably supported in the housing 11. As illustrated in FIG. 3, the output lever 12 and the lever 21 are connected to each other by a pin 18 provided within a second link portion 17, being inserted through the output lever 12 and the lever 21.

One end portion of the lever 21 is connected to the second link portion 17 of the output lever 12. The other end portion of the lever 21 is connected to one end portion of the component 22. The other end portion of the component 22 is connected to one end portion of the component 23 and connected to the component 24A. The other end portion of the component 23 is connected to the component 24B. The component 24A is connected to the rotational mechanism 51A of the contact 50A. The component 24B is connected to the rotational mechanism 51B of the contact 50B.

In the link mechanism 20, the component 24A that operates the contact 50A, and the components 23 and 24B that operate the contact 50B are connected to a common component 22. The lever 21 and the component 22 are operated in conjunction with the output lever 12, and thereby the contact 50A and the contact 50B can be simultaneously switched between on and off. The lever 21 and the component 22, which are components to be used commonly in operating the contact 50A and operating the contact 50B, are included in the link mechanism 20. This can reduce the number of components as compared to the case where the contact 50A and the contact 50B are separately operated by two separate link mechanisms. The contact 50A and the contact 50B are located next to each other, so that the common components, the lever 21 and the component 22, can be included in the link mechanism 20.

The link mechanism 20 is connected to the second link portion 17 of the output lever 12 to which the buffer 35 is linked. This can simplify the configuration of the output lever 12 as compared to the case where an additional link portion intended for connection of the link mechanism 20 is provided separately from the second link portion 17. The rotational shaft 13 of the output lever 12 and the rotational shafts of the rotational mechanisms 51A and 51B are located parallel to each other. Accordingly, due to the simple configuration of the link mechanism 20, the rotational mechanisms 51A and 51B can rotate in conjunction with rotation of the output lever 12.

The housing 11 is provided with, on its front side: gears 41 and 42 attached to the housing 11; a rotational lever 43 that is rotatable about a rotational shaft 45; and a link component 44 that links the rotational lever 43 to the gear 42. An end portion of a torsion bar 46 that is a switch-on spring is fixed to the rotational shaft 45. The torsion bar 46 is a bar-shaped elastic member. The torsion bar 46 applies a rotational force to the rotational lever 43. In FIG. 2, the torsion bar 46 is provided to extend from the rotational shaft 45 in the negative Y direction. The rotational lever 43 rotates by a spring force of the torsion bar 46.

The gear 41 is located so as to mesh with the gear 42. The gear 42 rotates by driving of a motor. FIGS. 2 to 4 omit illustrations of the motor. The gear 41 is not completely provided with teeth such that the gear 41 becomes out of mesh with the gear 42 when the torsion bar 46 is held in a twisted state.

FIG. 2 illustrates a state in which the movable contact 62 is in contact with the stationary contact 61 and the breaker 100 closes the power path. Operation of the breaker 100 when the breaker 100 opens the power path from the state illustrated in FIG. 2 will be described here. FIG. 5 illustrates a state when the breaker 100 illustrated in FIG. 2 opens the power path.

When the power path is in a closed state, the output lever 12 illustrated in FIG. 2 is applied with a rotational force in the counterclockwise direction by the torsion bar 14. A tripping latch mechanism stops the output lever 12 from rotating by the rotational force. FIGS. 2 and 5 omit illustrations of the tripping latch mechanism.

When the contact 50A receives the opening control signal S1 from the control panel 101, the contact 50A inputs the opening control signal S1 to the tripping electromagnet 30A. The tripping electromagnet 30A is excited by receiving the opening control signal S1 and thus drives the tripping latch mechanism. The tripping latch mechanism is driven and thereby cancels the stop of rotation of the output lever 12. When the tripping latch mechanism cancels the stop of rotation of the output lever 12, the output lever 12 rotates in the counterclockwise direction in FIG. 2. As the output lever 12 rotates, the movable contact 62 moves with the link mechanism 65 in the negative X direction, so that the movable contact 62 is pulled out from the stationary contact 61. Due to this operation, the breaker 100 opens the power path.

As the output lever 12 rotates, the lever 21 rotates in the clockwise direction from the state illustrated in FIG. 2. As the lever 21 rotates, the components 22 and 23 move from the state illustrated in FIG. 2 to the negative X direction. As the component 22 moves in the negative X direction, the component 24A rotates the rotational mechanism 51A in the counterclockwise direction. As the component 23 moves in the negative X direction, the component 24B rotates the rotational mechanism 51B in the counterclockwise direction. As the rotational mechanism 51A rotates in the counterclockwise direction, the contact 50A turns off the input of the opening control signal S1 to the tripping electromagnet 30A. Through the operation described above, the breaker 100 brings the power path into an opened state as illustrated in FIG. 5.

Next, operation of the breaker 100 when the breaker 100 closes the power path from the state illustrated in FIG. 5 will be described. When the power path is in an opened state, the rotational lever 43 illustrated in FIG. 5 is applied with a rotational force in the counterclockwise direction by the torsion bar 46. A switch-on latch mechanism stops the rotational lever 43 from rotating by the rotational force. FIGS. 2 and 5 omit illustrations of the switch-on latch mechanism.

When the contact 50B receives the closing control signal S2 from the control panel 101, the contact 50B inputs the closing control signal S2 to the switch-on electromagnet 30B. The switch-on electromagnet 30B is excited by receiving the closing control signal S2 and thus drives the switch-on latch mechanism. The switch-on latch mechanism is driven and thereby cancels the stop of rotation of the rotational lever 43. When the switch-on latch mechanism cancels the stop of rotation of the rotational lever 43, the rotational lever 43 rotates in the counterclockwise direction in FIG. 5. A cam is provided on a side of the gear 41 in the negative Y direction, and rotates along with rotation of the rotational lever 43. The rotational shaft of the cam is linked to the rotational lever 43 through the gear 41 and the link component 44. FIGS. 2 and 5 omit illustrations of the cam and the rotational shaft of the cam. The cam rotates and thereby pushes the output lever 12 illustrated in FIG. 5 such that the output lever 12 rotates in the clockwise direction.

The output lever 12 rotates while twisting the torsion bar 14. As the output lever 12 rotates, the movable contact 62 moves with the link mechanism 65 in the positive X direction, so that the movable contact 62 is inserted into the stationary contact 61. Due to this operation, the breaker 100 closes the power path. The output lever 12 is held again in the state illustrated in FIG. 2 by the tripping latch mechanism.

As the output lever 12 rotates, the lever 21 rotates in the counterclockwise direction from the state illustrated in FIG. 5. As the lever 21 rotates, the components 22 and 23 move from the state illustrated in FIG. 5 in the positive X direction. As the component 22 moves in the positive X direction, the component 24A rotates the rotational mechanism 51A in the clockwise direction. As the component 23 moves in the positive X direction, the component 24B rotates the rotational mechanism 51B in the clockwise direction. As the rotational mechanism 51B rotates in the clockwise direction, the contact 50B turns off the input of the closing control signal S2 to the switch-on electromagnet 30B.

The operation device 10 rotates the gear 42 by driving of the motor. The gear 41 rotates in conjunction with the rotation of the gear 42, and the link component 44 operates in conjunction with the gear 41. Consequently, the rotational lever 43 rotates in the clockwise direction while twisting the torsion bar 46. The rotational lever 43 is held again in the state illustrated in FIG. 2 by the switch-on latch mechanism. In the operation device 10, driving of the motor is stopped with the torsion bar 46 being in a twisted state. Through the operation described above, the breaker 100 brings the power path into a closed state as illustrated in FIG. 2.

Next, location of the auxiliary contact 50 in the breaker 100 will be described. The output lever 12 rotates so as to operate the first link portion 16 on the side toward a first direction with respect to the rotational center 15. The auxiliary contact 50 is attached to the operation device 10 at a position on the side toward a second direction with respect to the rotational center 15. In the first embodiment, the first direction is the positive Z direction. The second direction is opposite to the first direction and is the negative Z direction. The side toward the first direction refers to one side in a direction perpendicular to the movement direction of the movable contact 62 and perpendicular to the extending direction of the rotational shaft 13. The side toward the second direction refers to the opposite side to the side toward the first direction.

As compared to the case where the auxiliary contact 50 is located at a position away from the operation device 10, the breaker 100 can downsize the components constituting the link mechanism 20. As compared to the case where the auxiliary contact 50 is located at a position away from the operation device 10, the breaker 100 can reduce the number of the components of the link mechanism 20, and accordingly can simplify the configuration of the link mechanism 20. The auxiliary contact 50 is provided on the operation device 10, so that time and effort required for the layout design of the auxiliary contact 50 in each configuration of the breaker 100 can be reduced as compared to the case where the auxiliary contact 50 is located at a position away from the operation device 10.

The tripping electromagnet 30A and the switch-on electromagnet 30B are provided on the top face of the housing 11, the top face facing toward the positive Z direction. The buffer 35 is provided on the surface of the housing 11 facing toward the positive X direction, and the link mechanism 65 is led out from this surface toward the tank 63. The gears 41 and 42, the rotational lever 43, and the link component 44 are provided on the front face of the housing 11, the front face facing toward the positive Y direction. The torsion bars 14 and 46 are led out from the back face of the housing 11, the back face facing toward the negative Y direction. It is difficult to ensure a space for locating the auxiliary contact 50 on these four faces. The space may possibly be ensured on the face of the housing 11 facing toward the negative X direction. However, in a case where the auxiliary contact 50 is provided on this face, the auxiliary contact 50 is located at a position away from the output lever 12. In this case, the distance from the output lever 12 to the auxiliary contact 50 is increased, and it is necessary for the output lever 12 and the auxiliary contact 50 to be linked to each other while bypassing the constituent components positioned between the output lever 12 and the auxiliary contact 50. This makes it difficult to link the output lever 12 and the auxiliary contact 50 to each other.

Normally, there is not a constituent element that is essential to be located on the bottom plane of the housing 11, the face facing toward the negative Z direction. Therefore, a space for locating the auxiliary contact 50 can be easily ensured on the bottom plane of the housing 11. The auxiliary contact 50 is provided on the bottom plane of the housing 11, and can thereby be located at a position close to the second link portion 17 of the output lever 12.

The auxiliary contact 50 is not limited to a contact including two contacts, that is, a contact corresponding to the first control signal and a contact corresponding to the second control signal. It suffices that the auxiliary contact 50 includes a plurality of contacts, that is, two contacts or three or more contacts. The contacts are located next to each other on the bottom plane of the housing 11. The auxiliary contact 50 includes the contacts and thus can switch between turn-on and turn-off of the input of a plurality of control signals to the operation device 10.

According to the first embodiment, in the breaker 100, the auxiliary contact 50 is provided on the operation device 10 at a position on the side toward the negative Z direction with respect to the rotational center 15. This can simplify the configuration of the link mechanism 20. With this configuration, the breaker 100 achieves the effect of linking the auxiliary contact 50 and the operation device 10 to each other by the link mechanism 20 with a simple configuration.

The configurations described in the above embodiment are only examples of the content of the present invention. The configurations can be combined with other well-known techniques, and part of each of the configurations can be omitted or modified without departing from the scope of the present invention.

REFERENCE SIGNS LIST

10 operation device, 11 housing, 12 output lever, 13, 25, 45 rotational shaft, 14, 46 torsion bar, rotational center, 16 first link portion, 17 second link portion, 18 pin, 19 opening, 20, 65 link mechanism, lever, 22, 23, 24A, 24B component, 30A tripping electromagnet, 30B switch-on electromagnet, 31A, 31B control line, 35 buffer, 41, 42 gear, 43 rotational lever, 44 link component, 50 auxiliary contact, 50A, 50B contact, 51A, 51B rotational mechanism, 60 circuit contact, 61 stationary contact, 62 movable contact, 63 tank, 64 end face, 66 mounting seat, 100 breaker, 101 control panel, S1 opening control signal, S2 closing control signal.

The invention claimed is:

1. A breaker comprising:

a stationary contact;

a movable contact capable of being pulled out from the stationary contact and being inserted into the stationary contact;

a buffer to control operation of the movable contact;

an operation device including a first link portion linked to the movable contact and a second link portion linked to the buffer, and including an output lever rotatably supported, the operation device operating rotation of the output lever in accordance with a first control signal for a command for the pull-out and a second control signal for a command for the insertion;

an auxiliary contact to switch between turn-on and turn-off of an input of the first control signal and the second control signal to the operation device in conjunction with operation of the output lever, the auxiliary contact being able to be used in a circuit configuration to monitor a state of the operation device; and a link mechanism connected to the second link portion and linked between the output lever and the auxiliary contact to operate the auxiliary contact in conjunction with operation of the output lever, wherein the operation device includes a housing having the output lever accommodated therein, the output lever rotates so as to operate the first link portion on a side toward a first direction with respect to a rotational center of the output lever, the auxiliary contact is provided on the operation device at a position on a side toward a second direction with respect to the rotational center, the second direction being opposite to the first direction, the auxiliary contact including a plurality of contacts located next to each other on a plane of the housing, the plane facing toward the second direction, and a shaft direction in which the movable contact operates, and a shaft direction in which a part of the buffer linked to the second link portion operates are same as a direction in which the contacts are located next to each other.

2. The breaker according to claim 1, wherein the housing is provided with an opening through which the link mechanism is inserted.

3. The breaker according to claim 1, wherein the auxiliary contact includes a rotational mechanism to rotate so as to switch between turn-on and turn-off of an input of the first control signal and the second control signal, and a rotational shaft of the output lever is parallel to a rotational shaft of the rotational mechanism.

4. The breaker according to claim 1, comprising a torsion bar attached to a rotational shaft of the output lever to apply a rotational force to the output lever.

* * * * *